US007261849B2

(12) United States Patent
Miller et al.

(10) Patent No.: US 7,261,849 B2
(45) Date of Patent: Aug. 28, 2007

(54) TACKY POLYMER MELT SPINNING PROCESS

(75) Inventors: Richard W. Miller, Pensacola, FL (US); Walter J. Nunning, Pensacola, FL (US); Raymond S. Knorr, Pensacola Beach, FL (US)

(73) Assignee: Solutia, Inc., St. Louis, MO (US)

( * ) Notice: Subject to any disclaimer, the term of this patent is extended or adjusted under 35 U.S.C. 154(b) by 233 days.

(21) Appl. No.: 10/431,404

(22) Filed: May 7, 2003

(65) Prior Publication Data

US 2003/0201568 A1 Oct. 30, 2003

Related U.S. Application Data

(63) Continuation-in-part of application No. 10/135,888, filed on Apr. 30, 2002, now abandoned.

(51) Int. Cl.
*D01D 5/08* (2006.01)
*D01F 6/60* (2006.01)

(52) U.S. Cl. ..... 264/130; 264/211.12; 264/211.14

(58) Field of Classification Search ..... 264/130, 264/211.12, 211.14

See application file for complete search history.

(56) References Cited

U.S. PATENT DOCUMENTS

| | | | | |
|---|---|---|---|---|
| 2,252,999 A | | 8/1941 | Wallach et al. | 57/140 |
| 2,880,112 A | | 3/1959 | Drelich et al. | 117/37 |
| 3,410,832 A | | 11/1968 | Griehl et al. | 260/78 |
| 3,494,819 A | | 2/1970 | McAlister | 161/89 |
| 3,720,576 A | | 3/1973 | Fujisaki et al. | 161/173 |
| RE27,939 E | | 3/1974 | Raabe et al. | 260/78 |
| 3,877,214 A | | 4/1975 | Van der Werf | 57/164 |
| 3,889,028 A | | 6/1975 | Hösterey et al. | 428/88 |
| 3,901,989 A | | 8/1975 | Hokonoki et al. | 428/373 |
| 3,975,224 A | * | 8/1976 | Ruzek et al. | 264/210.8 X |
| 4,225,699 A | | 9/1980 | Schmid et al. | 528/324 |
| 4,258,094 A | | 3/1981 | Benedyk | 428/85 |
| 4,612,150 A | | 9/1986 | De Howitt | 264/103 |
| 4,632,861 A | | 12/1986 | Vassilatos | 428/296 |
| 4,634,739 A | * | 1/1987 | Vassilatos | 525/240 |
| 4,804,508 A | | 2/1989 | Double et al. | 264/103 |
| 4,842,922 A | | 6/1989 | Krupp et al. | 428/198 |

(Continued)

FOREIGN PATENT DOCUMENTS

EP 0 444 637 B1 2/1991

(Continued)

OTHER PUBLICATIONS

Article from Carpet & Rug Industry, Jul./Aug. 1996 entitled: "Polyethylene Binder Fibers for Carpets and Related Applications" by Richard J. Legare, Rakesh K. Gupta and Randall E. Kozulla.

*Primary Examiner*—Leo B. Tentoni
(74) *Attorney, Agent, or Firm*—Jones, Tullar & Cooper, P.C.; John P. Foryt

(57) ABSTRACT

A method for high speed melt spinning of binder fiber by melting a polymer having a melting temperature range of greater than 0° C. to 160° C., spinning said polymer at a speed of greater than about 2000 meters per minute to form the binder fibers; and winding the binder fiber onto a spin bobbin.

11 Claims, 5 Drawing Sheets

U.S. PATENT DOCUMENTS

| | | | | |
|---|---|---|---|---|
| 4,863,662 | A | 9/1989 | Hasegawa et al. | 264/130 |
| 4,909,976 | A | 3/1990 | Cuculo et al. | 264/211.15 |
| 5,281,378 | A | 1/1994 | Kozulla | 264/83 |
| 5,284,009 | A | 2/1994 | Tung et al. | 57/239 |
| 5,411,693 | A | 5/1995 | Wust, Jr. | 264/171 |
| 5,478,624 | A | 12/1995 | Lofquist | 428/97 |
| 5,618,624 | A | 4/1997 | Dinger et al. | 428/368 |
| 5,712,209 | A | 1/1998 | Geiman | 442/208 |
| 5,733,646 | A | 3/1998 | Gupta et al. | 428/288 |
| 5,888,438 | A | 3/1999 | Gupta et al. | 264/176.1 |
| 5,958,806 | A | 9/1999 | Jensen et al. | 442/401 |
| 5,993,714 | A | 11/1999 | Sawyer et al. | 264/168 |

FOREIGN PATENT DOCUMENTS

| | | |
|---|---|---|
| GB | 1 201 101 | 8/1970 |
| GB | 1 304 504 | 1/1973 |
| GB | 1 304 865 | 1/1973 |
| GB | 1168404 | 10/1996 |
| WO | WO-8803969 A1 * | 6/1988 |

* cited by examiner

TACKY POLYMER MELT SPINNING PROCESS

This is a continuation-in-part of application Ser. No. 10/135,888 filed Apr. 30, 2002, now abandoned.

FIELD OF THE INVENTION

The present invention relates generally to a binder fiber and a method of making such binder fiber. The present invention also relates to the use of such binder fiber in yarns and textile materials.

BACKGROUND

It is known that binder fibers may be blended with base or non-adhesive fibers to form a yarn or textile material and then the binder fiber may be melted, thereby adhering the base fibers together. See U.S. Pat. Nos. 2,880,112, 2,252,999, 3,877,214, 3,494,819 and 5,284,009, the entire subject matter of which is incorporated herein by reference. Typically, the binder fiber melts at temperatures sufficiently less than those at which the base fibers melt or begin softening, thereby allowing the base fibers to retain their physical properties while at the same time imparting the yarn or textile material with significantly improved properties (e.g., wearability, initial appearance, etc.).

Selection of binder fiber materials is important with regard to achieving improved properties in the resulting yarn or textile materials. Certain physical and chemical characteristics of binder materials are desirable, such as ability to adhere to the base fiber, ability to flow between base fibers under standard process conditions and/or ability to be unwound at high speeds (i.e., greater than 1,000 mpm). For example, U.S. Pat. No. 4,258,094, the entire subject matter of which is incorporated herein for reference, describes the use of an ethylene-vinyl acetate binder fiber with a base fiber to form melt bonded fabrics. U.S. Pat. No. 5,478,624, the entire subject matter of which in incorporated herein by reference, sets forth a synthetic yarn prepared from a blend of base fiber combined with a polyamide copolymer binder fiber. The yarn is utilized in a carpet and is heated to bond the base fibers together. U.S. Pat. No. 5,712,209, the entire subject matter of which is incorporated herein by reference, describes the use of polyethylene fibers as binder fibers in combination with base fibers that melt at temperatures above the melting ranges of the polyethylene fibers. The polyethylene fibers are melted to "lock" the base fibers in place, thereby producing a "dimensionally stable" structure.

Because binder fibers desirably melt at temperature ranges below those of base fibers, the binder material typically is limited to polymers having low melting temperature ranges (e.g., below about 200° C.). Many of these polymers possess a low propensity to crystallize (i.e., to form the stable inter- and intra-molecular associations with some degree of molecular periodicity that can be characterized by increased density, reduced shrinkage, a measurable endothermic heat of melting, and discrete x-ray scattering), if they do crystallize at all. Melt spinning of polymers having a low propensity to crystallize (i.e., to form a stable micromolecular crystalline structure) is quite difficult for a number of reasons, including low melt strength, quench difficulty and poor package formation. For example, various problems with melt spinning of low melting (e.g., below about 160° C.) polyamides is described in U.S. Pat. No. 4,225,699, the entire subject mater of which is incorporated herein by reference. The most significant problem to overcome lies in the "sticking" of filaments together and to the spin bobbin after being placed thereon. In a typical melt spinning process, after spinning the polymer into a multi-filament yarn, the yarn is quenched and then wound onto a spin bobbin. Subsequently the yarn is removed form the spin bobbin for further processing, such as drawing, annealing, finishing, inserting, etc. If the yarn is not easily withdrawn from the spin bobbin filament breakage occurs, resulting in a yarn that cannot be processed into satisfactory products.

In order to reduce sticking of melt spun filaments composed of low melting polymers, various processes and processing aids have been developed. For example, U.S. Pat. No. 3,901,989, the entire subject matter of which is incorporated herein by reference, describes a process for melt spinning a bicomponent fiber using a spin-draw technique that involves stretching or drawing of the multi-filament yarn after spinning and quenching. However, such spin-draw processes cannot be performed at high speed and are, thus, not commercially viable for commercial-type applications.

Another process for alleviating the sticking phenomenon relates to the quenching process. For example, improved cooling of the fiber during the quench step by increasing the velocity of the quench fluid is proposed in U.S. Pat. No. 5,411,693, the entire subject matter of which is incorporated herein by reference. However, the polymers utilized in this process melt at high temperature ranges and have a high propensity to crystallize. This process would not provide satisfactory results when spinning a low temperature melting polymer that has a low propensity to crystallize because such a filament's melt strength would be too low.

The aforementioned U.S. Pat. No. 4,225,699 does describe melt spinning of low melting polymers having a low propensity to crystallize. However, the process recited therein is conducted at low spinning speeds (i.e., 800 m/min.) and utilizes a spin draw technique, thereby rendering the processing commercially unacceptable for the reasons mentioned herein. Additionally, the unwinding tension of the filaments from the spin bobbin is quite high (i.e., above four grams) and is not suitable for existing commercial yarn insertion processes due to the propensity for breakage of the binder filaments.

There have been efforts to implement high speed melt spinning of various polymers into fibers. For example, U.S. Pat. No. 4,909,976, the entire subject matter of which is incorporated herein by reference, describes a process for high speed melt spinning of polyester using on-line zone cooling and heating. However, polyester is a high melting temperature (i.e., above 250° C.) polymer that exhibits a high propensity to crystallize (i.e., to form stable micromolecular structures of increased density) during the quenching process when spun at higher speeds. In contrast, polymers possessing a low melting temperature range with a low propensity to crystallize have not been melt spun at high speeds due to a low expectation of success because the low degree of stress induced crystallization expected from orienting the amorphous polymer chains in the filaments emerging from the quench zone. Such filaments typically must be further treated (i.e., cooled, drawn, annealed, etc.) in order to reduce sticking of the filaments placed on the spin bobbin, as mentioned in U.S. Pat. No. 4,225,699.

Accordingly, there is a need for a commercially viable high speed melt spinning process that produces acceptable non-sticking filaments composed of polymers possessing a low melting temperature range with a low propensity to crystallize.

SUMMARY OF THE INVENTION

The present invention relates to a method for high speed melt spinning of a binder fiber by melting a polymer that exhibits substantially no exothermic crystallization peak as measured by DSC when it is cooled to solidification from a molten state according to test A, spinning the polymer at a speed of greater than about 2000 meters per minute to form the binder fiber, and winding the binder fiber onto a spin bobbin.

The present invention also is directed to a method for high speed melt spinning of binder fiber by melting a polymer having a melting temperature range of greater than 0° C. to 160° C., spinning the polymer at a speed of greater than about 2000 meters per minute to form the binder fiber and winding the binder fiber onto a spin bobbin.

DETAILED DESCRIPTION OF PREFERRED EMBODIMENTS

Figure 1:
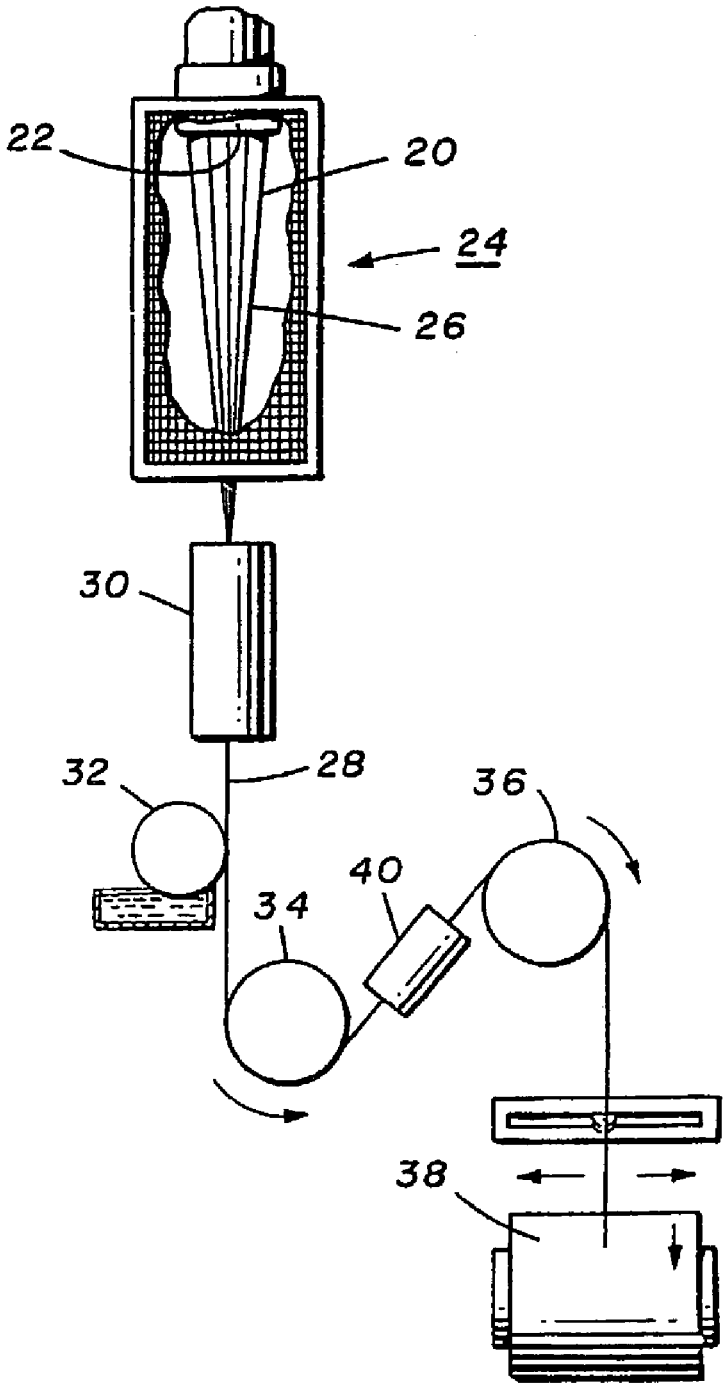
FIG. 1 depicts a schematic of an embodiment of a process of the present invention.

The carpets of the present invention may be made using, instead of only conventional carpet fibers, a combination of fibers comprising conventional carpet fiber and binder fiber. The term "binder fiber", as used herein, refers to binder staple fiber or binder monofilament or binder yarn, where the binder fiber may be comprised exclusively of a binder material or a binder material combined with a non-binder material. The term "binder material" refers to a material that will melt or soften during heatsetting and thereby mechanically and/or chemically bond conventional carpet fibers together and the term "non-binder material" refers to a material that will not melt or soften during heatsetting, such as conventional carpet fiber. For example, the binder fiber may be in the form of a yarn comprising binder fiber or conventional staple fiber and binder fiber, or the binder fiber may comprise a binder-non-binder material bicomponent fiber, such as a binder material sheath over a non-binder material core, or a non-binder material yarn coated with a binder material. The term "yarn" refers to a staple fiber yarn (either a singles or a ply-twisted yarn) or a bulked continuous filament (BCF) yarn (either singles or cabled yarn). The present invention relates preferably to ply-twisted yarns, comprising carpet yarn comprising a conventional staple fiber yarn combined with binder fiber in the form of multifilament yarn. The carpet made from these plied-yarn blends comprises a primary backing and twisted evenly sheared, heatset pile yarn in the form of individual lengths of plied yarn (tufts), each of which projects upwardly from the backing and terminates as a cut end (cut pile) or uncut end (loop).

Carpet fibers that may be utilized in making the fiber blends of the present invention are typically crimped fibers having deniers of at least 1 denier per filament (dpf) and a crimp frequency of greater than 1 crimps-per-inch, and more preferably between 5 and 16 crimps-per-inch. (The term "carpet fibers", as used herein, refers to conventional carpet fibers (staple or continuous filament) described in this paragraph and the term "carpet yarn", as used herein, refers to yarns made from said carpet fibers). Preferably, the carpet fibers have deniers of at least 8, usually between 12 and 25, and a non-round cross-section (e.g., trilobal cross-section). Preferred carpet fibers are polyamides, particularly nylon 6 and nylon 66, polyesters, particularly poly(ethylene terephthalate), olefins, particularly polypropylene, acrylics, and combinations thereof. Other suitable carpet fibers include other nylons and polyester fibers, such as nylon 6/12 fibers or polybutylene terephthalate fibers. The carpet fibers can also include additives such as light stabilizers, flame retardants, dyes, pigments, optical brighteners, antistatic agents, surfactants and soil release agents.

The binder material useful in making the carpet yarn of the present invention typically has a melting range that falls between 60-190° C., preferably of about 65-160° C., more preferably of about 70-140° C., under ambient humidity conditions (i.e., as described in Test A), where the melting range is considered to be the endothermic portion of the DSC (Differential Scanning Calorimeter) scan (scan rate of approximately 20° C./minute). Note: Endothermic transitions for this class of low crystalline material will reflect polymeric reorganizations, softening, and true melting, all here referred to as comprising the melting range, and is demonstrated in the DSC by deviation from the baseline. The binder material should also be capable of wetting and spreading on the carpet fiber in order to provide adequate adhesion during any subsequent dyeing steps and final use. In the binder material, it may be advantageous to utilize additives to reduce melt viscosity, enhance wetting properties or modify melting temperature. In addition, special spin finishes may be utilized which impart necessary antistatic and lubricating properties to the binder material for efficient mill processing. Preferably, the binder material is economic, compatible with the conventional carpet fibers so as to enable it to adhere thereto, and capable of being activated, i.e., melted or sufficiently softened at the temperatures normally found in conventional heatsetting apparatus such as a Superba® or Suessen® heatsetting unit, available from American Superba, Inc. and American Suessen Corp., respectively.

The binder material may be comprised of any polymer, including any polymers having one or more components (i.e., copolymers, terpolymers, etc.), provided that they possess the binder characteristics defined herein. The preferred binder material is made from low cost components, such as nylon 6, nylon 66 and nylon 12. One example of such a binder material for polyamide carpet fibers is a fiber melt spun from a copolyamide comprised of nylon 6, nylon 66 and nylon 12 (referred to herein as 6/66/12, e.g., Griltex® 1AGF, available from EMS-Chemie, Inc.), plus a chain terminator to control molecular weight. Another example of a low cost binder material is the polyamide fiber spun from copolymers of nylon 6 and nylon 69 or terpolymers of nylon 6, nylon 66 and nylon 69. Of particular value is the 6/69 copolymer comprised of about 25 to about 65 wt % nylon 6 (referred to herein as 6/69). Copolymers in this composition range have a melting range of greater than 0° C. to less than about 150° C. and are readily melt spun. More preferred nylon 6/69 copolymers possess melting ranges of greater than 0° C. to less than about 130° C. and are composed of about 35 to about 55 wt % nylon 6. Terpolymers generally give better adhesion, but are often more difficult to melt spin. Examples of suitable 6/66/69 compositions include 40/20/40 (wt %); 25/20/55 (wt %) and 40/10/50 (wt %), available from Shakespeare Specialty Polymers. Other components or precursors for making the copolyamide may be substituted for or used in addition to any of the three components listed above, as needed to achieve the desired binder fiber properties. Examples of other suitable components include lactams, amino acids or salts of diacids and diamines. Examples of diacids, which may be used along with a diamine, such as hexamethylene diamine, are isophthalic acid, undecanoic acid, docecanoic acid, azelaic acid and sebacic acid. Examples of diamines, which may be used along with a diacid, such as adipic acid are ethylene diamine, hexamethylene diamine and nonamethylenediamine. The preferred components are those that are readily available commercially and form linear copolyamides, which may be melt spun on conventional spinning machines.

By selection of various component, their amounts, and synthesis of the thermally activated, binder material, it is possible to modify end-use properties of the finished carpet to improve carpet aesthetics, particularly tuft (or loop) definition, worn appearance retention, resilience, and fuzz/bearding. The thermal shrinkage, tenacity, modulus, elongation to break, melt viscosity, softening point, and melting point of the binder material contribute to achieving ideal properties in the final product. Moreover, various properties of the carpet fiber, including denier-per-filament, cut length, fiber cross-section, crimp type and frequency, surface finish, melt viscosity, and dye affinity, among others, also affect the properties of the resulting carpet.

In another embodiment, the binder fiber of the present invention is constructed of a polymer that when melted exhibits substantially no exothermic crystallization peak as measured by DSC as it is cooled to solidification from a molten state. According to the present invention, a method for conducting such a DSC test is designated herein as Test A and is described as follows:

Test A

Test A is conducted as follows: The melting characterization of binder fiber and carpet fiber samples (between 2 and 10 mgs) after conditioning at 21 degrees Celsius and 61% relative humidity for one day prior to testing are measured on a Perkin Elmer (PE) Pyris 1 Differential Scanning Calorimeter (DSC) equipped with a sub-ambient cooling unit and continuously purged with nitrogen gas. Fiber samples of 2 to 4 mm length are prepared using a cutting board and razor blade, then encased in a DSC pan using the PE pan crimper and vented with five punched holes. To assess melting behavior and propensity to recrystallize, each sample is held at −50 degrees C. for 5 minutes heated at 20 degrees C. per minute to 200 degrees C., held there for 5 minutes, then cooled to −50 degrees C. at 20 degrees C. per minute where again it is held for 5 minutes before reheating to 200 degrees C. at 20 degrees C. per minute.

Figure 2:
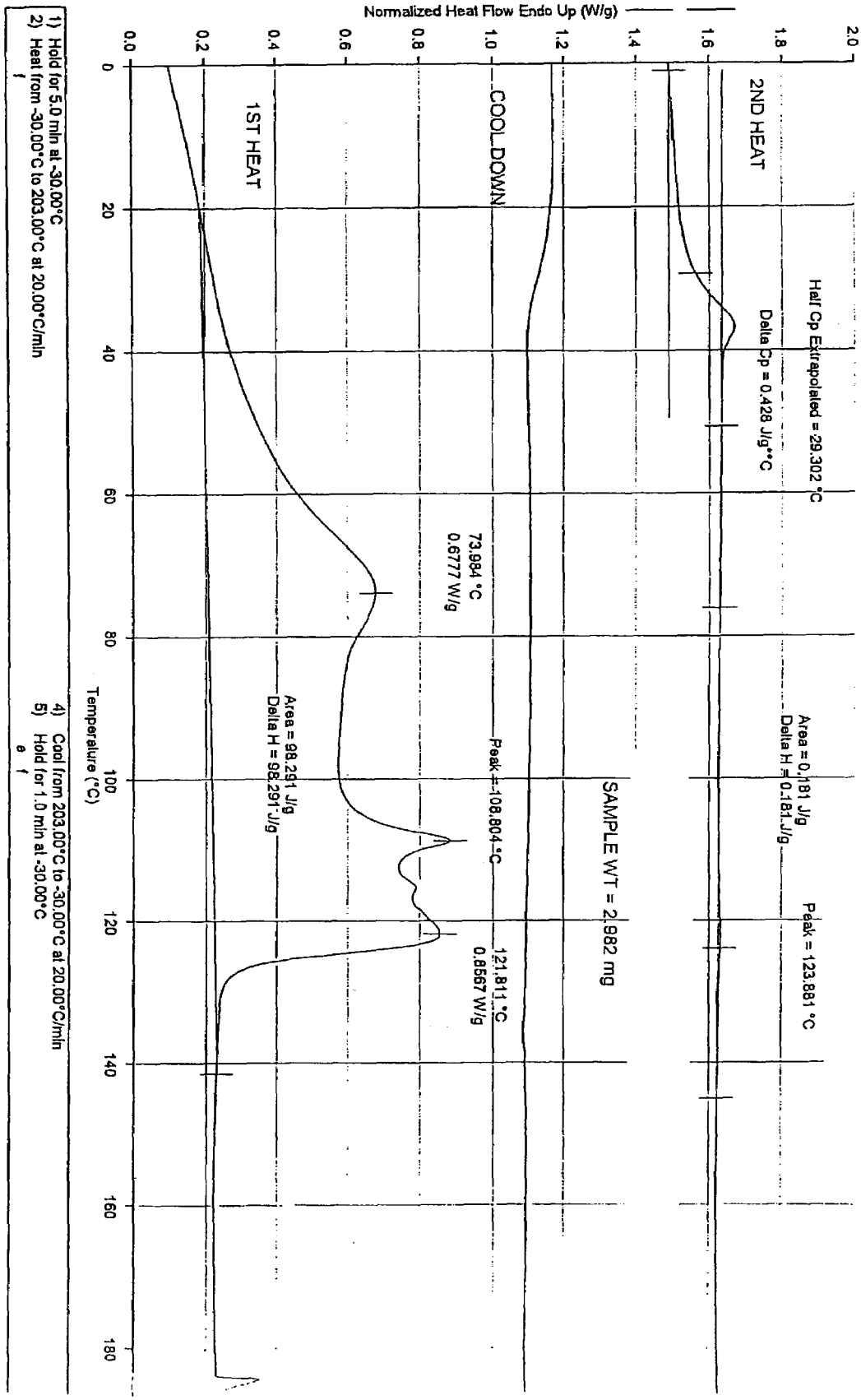
FIG. 2 is a graph representing melting characteristics of a nylon 6/66/12 (Griltex® 1AGF) yarn sample as measured by a differential scanning colorimeter (DSC).

As shown in FIG. 2, the Griltex® 1AGF exhibits major endothermic peaks at about 70 degrees C. and between about 108 and 122 degrees C.; no exothermic recrystallization peaks are evident on cooling; and no endothermic melting peaks above 100 degrees C. are evident on reheating.

FIG. 2 is a graph representing melting/cooling/remelting characteristics of a nylon 6/66/12 (Griltex® 1AGF) yarn sample as measured by DSC using Test A. As is readily apparent from the graph, the polymer exhibits substantially no exothermic crystallization peak when it is cooled to solidification from the molten state. "Substantially" no exothermic crystallization peak means that the peak area of the exothermic peak is less than 30 percent of the area of the endothermic reorganization/melting peaks obtained for the initial melting by drawing a baseline from 20 to 160 degrees C. and measuring the endothermic areas above said baseline.

Figure 3:
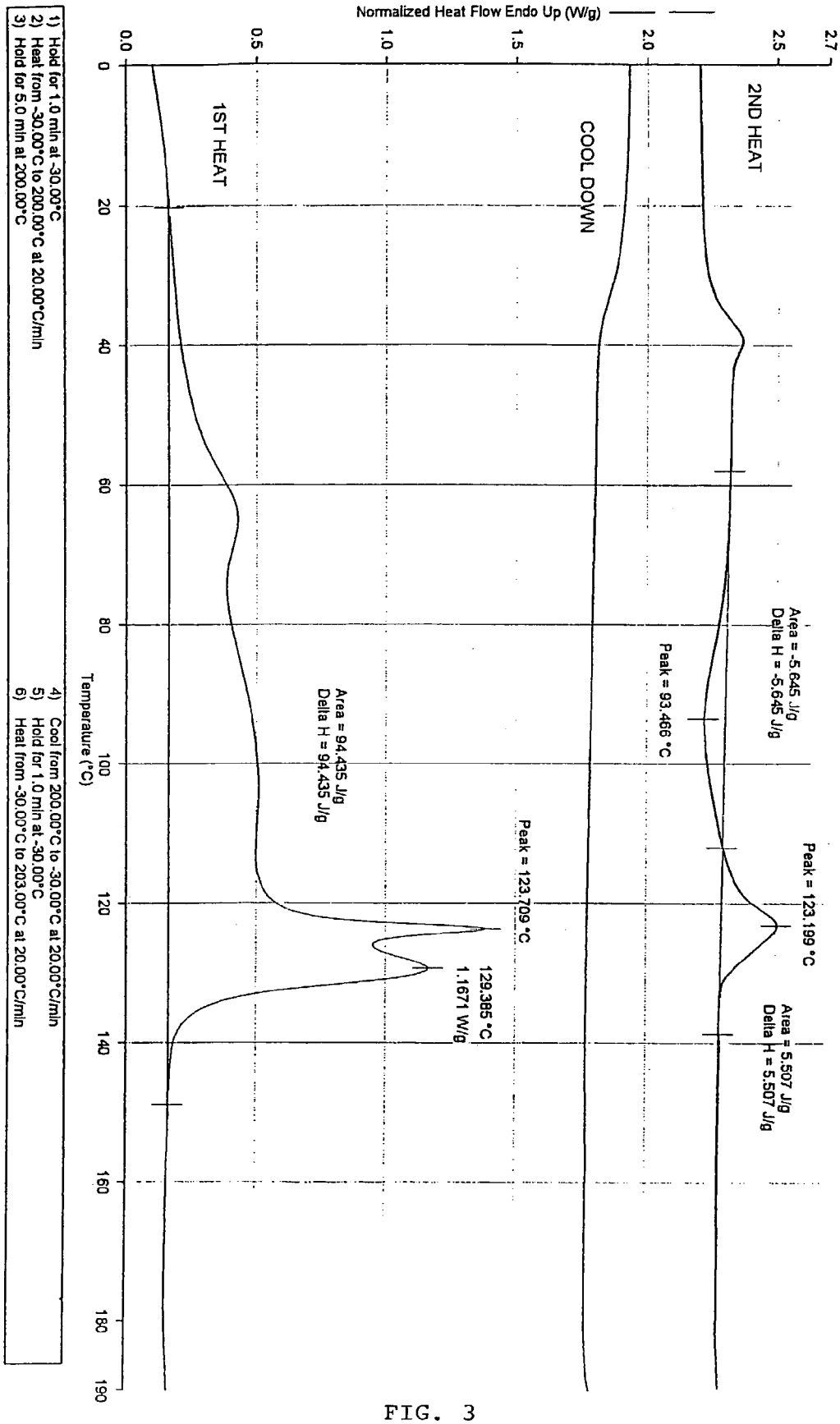
FIG. 3 is a graph representing melting characteristics of a nylon 6/69 yarn sample as measured by a DSC.

FIG. 3 is a graph representing melting characteristics of a nylon 6/69 yarn sample as measured by DSC using Test A. As is readily apparent from the graph, the polymer exhibits substantially no exothermic crystallization peak when it is cooled to solidification from the molten state. As used herein, "melting characteristics" represent the melting, cooling and remelting of yarn samples in accordance with the method described in Test A.

Figure 4:
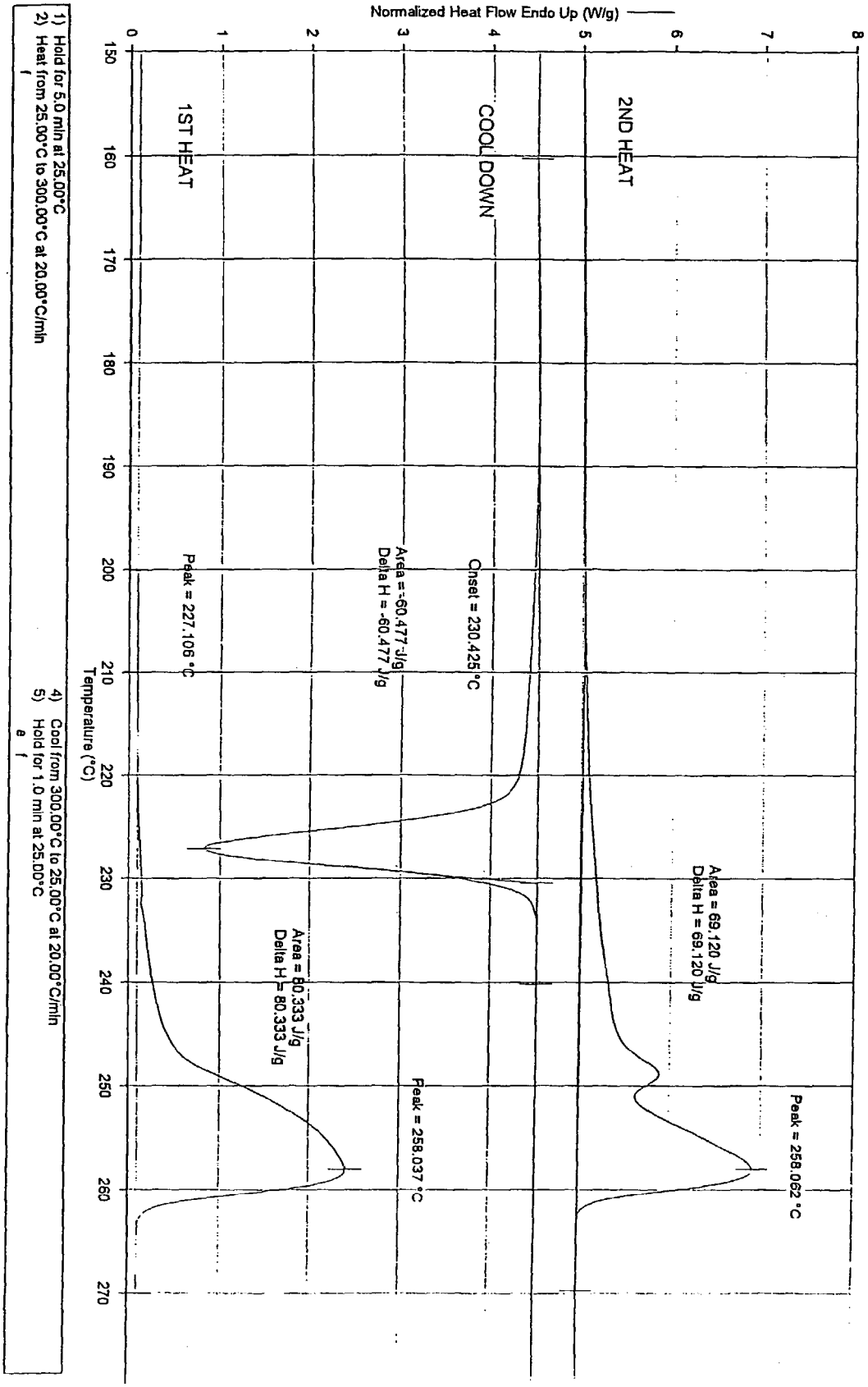
FIG. 4 is a graph representing melting characteristics of a nylon 66 yarn sample as measured by a DSC.
Figure 5:
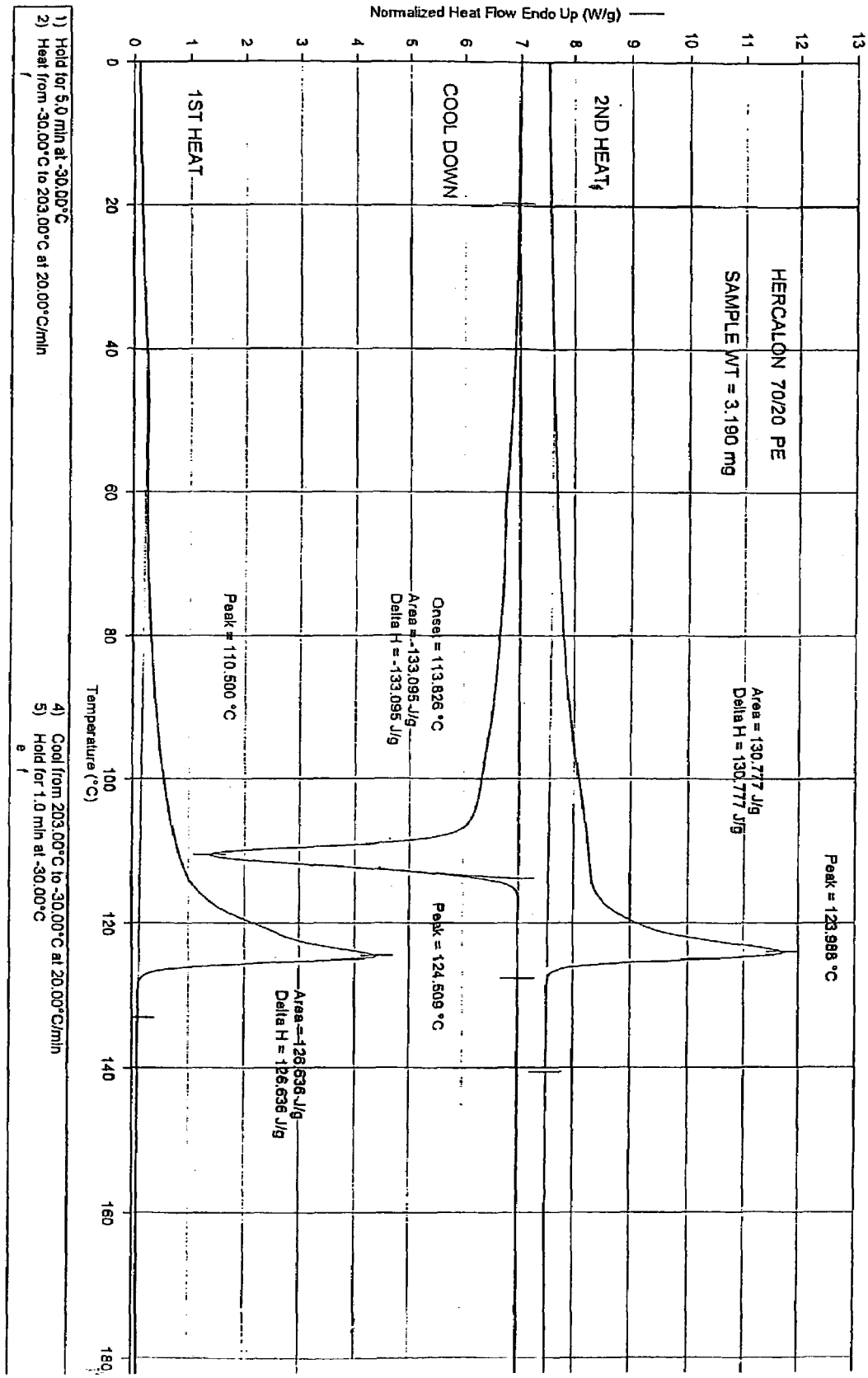
FIG. 5 is a graph representing melting characteristics of a functionalized polyethylene yarn (Herculon®) sample as measured by a DSC.

In contrast, FIGS. 4 and 5 represent melting characteristics of polymer yarn samples that demonstrate substantial exothermic crystallization peaks when cooled to solidification from molten states.

In accordance with the present invention, it has been discovered that binder fiber made from polymers that exhibit no exothermic crystallization peaks when cooled to solidification from a molten state using Test A provide improved results in various textile applications. Inserting binder fibers made from each of the polymers documented in Table I (at the 2 percent level into a nylon 66 staple yarn) improved carpet wear (AR), and carpet tuft endpoint. The N6/N66/N12 and N6/N69 (Examples I and IV) binder fibers in particular, showed significantly better results for carpet wear (AR) and carpet endpoint. Both lacked evidence of recrystallization on cooling from the melt via Test A.

Moreover, under the present invention it has been further discovered that such polymers may be unexpectedly melt-spun into fibers using high speeds (e.g., above about 2000 mpm). Low speed spinning attempts failed to produce acceptable packages (bobbins) of continuous filament yarn that were made from melt-spun fibers from polymers characterized by low-melting temperature. The fibers stuck to one another and couldn't be unwound at the speeds encountered during further processing. While this problem could be solved by introducing further processing steps (heating and/or drawing), it was unexpectedly found that spinning these polymers at speeds above 2000 mpm increased the spin-line stress on the filaments enough to make the resultant spun packages usable. Evidently, the resultant changes in fiber morphology—increased molecular orientation and the beginnings of crystallization—limited the fiber's stickiness. It is not obvious that this degree of molecular change (evidenced by a reluctance to recrystallize on cooling from the melt) would reduce the degree of stickiness. One of ordinary skill in the art would have expected this low degree of crystallization to not impact the degree of stickiness, as opposed to other more readily crystallizable polymers such as the nylon 6/66 copolymer or the functionalized polyethylenes. As is readily apparent from Table II, spinning speeds of the low crystalline polymers of the present invention of greater than about 2000 mpm clearly provide fibers that possess an unexpected degree of reduced stickiness. Preferably, the polymers may be melt-spun into fibers at speeds above about 2500 mpm, more preferably above about 3000 mpm, and most preferably above about 3500 mpm.

The conventional carpet manufacturing process for staple carpet fiber takes randomly oriented carpet fibers and subjects them to a series of carding and pinning operations to blend and orient the individual carpet fibers in a common direction. The final drafting stage, spinning, imparts twist to form a continuous, singles yarn comprised of many short fibers twisted together; commonly 40-150 fibers would be found in any cross-section. In the present invention, binder fiber may be blended as staple fiber with the conventional carpet staple fibers in the early stages of carding or inserted as a continuous binder fiber yarn after the final drafting into the spun singles package.

Two or more conventional carpet singles yarns may then be twisted together using a variety of plytwisting processes: e.g., ring twisting, 2-for-1 twisting, or open-ended twisting. The present invention relates preferably to inserting the binder fiber as a yarn prior to plytwisting. This may be accomplished employing a variety of different techniques, and the binder fiber is preferably positioned between at least two singles yarns. The binder fiber may be inserted during a doubling process, also referred to as a parallel winding, whereby the binder fiber is joined with two other singles yarns and subsequently wound onto a package that is 2-for-1 twisted. Another method is to join the binder fiber with a singles yarn and wind onto a package via a Murata® (available from Murata Machinery, LTD), Schlafhorst® (available from W. Schlafhorst and Co.) or other auto winder device. The binder fiber/singles package is then placed into a 2-for-1 twister along with a second singles package containing no binder fiber. Still another process involves inserting the binder fiber directly into a ring twister from a creel containing two singles yarns and a binder fiber bobbin. A technique also exists which allows for direct insertion of the binder fiber into the Murata®, Schlafhorst® or other auto winder device such that the package formed is available for 2-for-1 twisting with a second package containing no binder fiber insert. Then the yarn is processed through a conventional heatsetting unit such as a Superba® or Suessen® to set the imparted twist and in the present invention to melt or soften the binder fiber. Typically, Superba® heatsetting subjects the nylon 66 yarn to temperatures of 132-138° C. in a pressurized steam environment and Suessen® heatsetting subjects the nylon 66 yarn to temperatures of 195-200° C. in a superheated steam environment. The heatset yarns may then be tufted into carpet and dyed conventionally to produce cut-pile saxony, cut-pile textured, loop, and combination loop and cut-pile carpets.

FIG. 1 represents an embodiment of a process according to the present invention. In one embodiment, Griltex® 1AGF, a commercially available nylon 6/66/12 (Griltex® 1AGF) copolymer resin from EMS-Chemie (North America) Inc., a 0.32 percent moisture level, and a 1.56 relative viscosity (measured in sulfuric acid according to ASTM D4066) is spun at a melt temperature of 160 degrees C. Spinneret 22 contains round capillaries having lengths of 0.015" (0.38 mm) and diameters of 0.020" (0.51 mm). Quench zone 24 is 35 inches in height, and is supplied with 20 degree C. quench air having an average horizontal velocity of 1 foot (30.5 cm) per second. Filaments 26 are converged into yarn 28 approximately 36 inches (91.4 cm) below the spinneret. A conventional, low friction spin finish is applied to yarn 28 by finish roll 32. Yarn 28 next passes in partial wraps about godets 34 and 36, the speed of which are 4450 meters per minute and 4500 meters per minute, respectively, to prevent the yarn from wrapping on godet 36. The polymer metering rate is selected such that the yarn is wound onto a bobbin 38 at a denier of 70. The winder used is the Toray 601, and the winder speed (about 4435 meters per minute) is adjusted to provide a winding tension of 0.1 grams per denier.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLES I-IV

These examples illustrate the preparation of carpet fiber/binder fiber blends of the invention and the improved worn surface appearance and initial carpet aesthetics characteristics (e.g., tuft endpoint) of cut-pile carpet made therefrom. Test carpets are made using conventionally crimped nylon 66 carpet staple fibers which are uniform in appearance and have a length of 7½ inches, a denier of 15, and an average of 10.5 crimps per inch. These fibers are carded and spun into singles yarn; the singles yarn inserted with a 70 denier/10 filament binder fiber (Example I: N6/N66/N12 binder fiber; Example II: N6/N66 binder fiber; Example III: functionalized PE binder fiber; Example IV: N6/N69 binder fiber) at parallel winding through the Marata® (at speeds of 1200 mpm); then a singles without the binder fiber and a singles with the binder fiber are plied together in a 2-for-1 twisting operation. Though multiple comparisons were made contrasting carpets made from yarns inserted with the binder fiber against carpets not inserted with the binder fiber—both made under the same yarn and carpet constructions—(73 for Example 1, 7 for Example 2, 6 for Example III, and 2 for Example IV) under a variety of yarn and carpet construction parameters, a typical plied yarn is made at a 3.5/2 cotton count (cc) and twisted at 5.25Z (singles)×5.25S (ply). Test yarns, including those with binder fiber, are textured and heatset (stuffer box and Suessen at 200° C.), tufted into a textured cut-pile carpet construction (45 oz face weight, 18/32" pile height, 5/32 gauge is typical), and then continuous fluid dyed to a variety of shades.

Appearance loss between each of the untrafficked and trafficked (20,000 steps) carpets is determined by evaluating the appearance retention (AR) of the walked carpet using a single grader knowledgeable in the area of carpet testing and reference photographs in the manner described in ASTM D2402. The grader determines an ASTM grade for two, replicate carpets of each trafficked, Test carpet and averages the grade: the lower the average grade, the lower the perceived change in the test carpet's appearance after trafficking. The AR contrast is the AR grade of the Test carpet blended with the binder fiber minus the AR grade of the Test carpet excluding the binder fiber. Except for the binder fiber, both Test yarns and carpets are constructed identically.

Untrafficked carpet aesthetics, here tuft endpoint definition, is determined by contrasting the relative endpoint definition—the tighter, better defined the tuft endpoint, the better—of an untrafficked Test carpet inserted with the binder fiber against a Test carpet made without the binder fiber but otherwise constructed identically. Nine degrees of contrast [from much worse (−2) to much better (+2) in half grade increments] are assigned by a single grader knowledgeable in the area of carpet testing.

The results, as set forth in Table I, clearly indicate that the carpets of Examples I and IV, prepared from polymers of the present invention, produce carpets superior in appearance retention (−1.13 and −1.50 AR) and untrafficked carpet tuft endpoint (+1.02 and +1.00 endpoint) to identically constructed carpets lacking the binder fiber. Carpets of Examples II and III, prepared from polymers outside the present invention, exhibited significantly less improvement in AR (−0.49 and −0.17) and endpoint (+0.64 and +0.10) between carpets made with the binder fiber insert and carpets made without a binder fiber insert.

TABLE I

Carpet Property Contrast Between Inserted and Uninserted Carpets

| | Insert Yarn Types | | | |
|---|---|---|---|---|
| | Example I (N6/N66/N12) (MP to 110C) | Example II (N6/N66) (MP: 170–180C) | Example III (Func PE) (MP: 120–135C) | Example IV (N6/N69) (MP: 130–135C) |
| Comparisons: | 73 | 7 | 6 | 2 |
| (Average) AR Contrast | −1.13 (+/−0.13)* | −0.49 | −0.17 | −1.50 |
| Endpoint Contrast | +1.02 (+/−0.12) | +0.64 | +0.10 | +1.00 |

*95% Confidence Interval (72 degrees of freedom)

TABLE II

Binder Yarn Bobbin Unwinding Properties according to Test B

| Examples | Spinning Speed (mpm) | Stick (%) | Avg (gm) | St Dev (gm) | <0.5 gm (%) | 0.5–1.5 gm (%) | 1.5–2.5 gm (%) | 2.5–3.5 gm (%) | >3.5 gm (%) |
|---|---|---|---|---|---|---|---|---|---|
| V | 500 | * | * | * | * | * | * | * | * |
| VI | 1000 | 8.30 | 2.54 | 0.78 | 1.2 | 6.9 | 10.2 | 14.9 | 64.7 |
| VII | 1500 | 4.20 | 1.57 | 0.74 | 0.0 | 51.4 | 26.9 | 10.8 | 11.0 |
| VIII | 2000 | 6.35 | 1.47 | 0.63 | 29.9 | 23.2 | 16.6 | 11.2 | 19.1 |
| IX | 2500 | 1.36 | 1.04 | 0.88 | 42.3 | 26.6 | 21.6 | 6.7 | 2.8 |
| X | 3000 | 0.08 | 0.49 | 0.38 | 66.6 | 31.0 | 2.3 | 0.0 | 0.1 |
| XI | 3500 | 0.00 | 0.22 | 0.08 | 99.3 | 0.7 | 0.0 | 0.0 | 0.0 |
| XII | 4000 | 0.00 | 0.36 | 0.17 | 86.2 | 13.7 | 0.1 | 0.0 | 0.0 |
| XIII | 4435 | 0.60 | 0.34 | 0.31 | 85.9 | 11.0 | 0.7 | 0.5 | 2.0 |

*The yarn could not be removed from the bobbin due to extreme adhesion.

EXAMPLES IV-XIII

Binder yarns are fabricated according to the process referred to in FIG. 1, but at different spinning speeds, as indicated in TABLE II. All yarn packages to be tested are conditioned at 21 degrees C. and 65% relative humidity for one day prior to testing.

Test B is conducted at follows: The binder yarn's unwinding characteristics are measured one week after spinning. Each bobbin of binder yarn is subjected to the following characterization. Fifty yards of binder yarn are stripped from the bobbin and discarded. The binder yarn is then unwound at a 100 mpm speed and the tension (gms) measured every one-half second for a 12 minute period (1200 meters of yarn tested, 1440 measurements taken) using a tensometer available from Tension Measurement, Inc. The percentage of data involved in a stick point (Stick (%)) (defined as greater than 4 grams force measured), the average tension (Avg (gms)) and standard deviation of tension (St Dev (gm)) of data excluding those data involved in stick points, and the percentage of data measuring less than 0.5 gms force, 0.5-to-1.5 gms force, 2.5-to-3.5 gms force, and greater than 3.5 gms force are recorded in TABLE II. These results clearly demonstrate the unexpected reduction in stickiness of the fiber: Example V could not be pulled from the bobbin, Examples VI, VII, VIII, and IX show much higher percentages of the data are involved in stick points and those data not involved in stick points exhibiting higher average tensions and greater percentages of the data at higher tension levels than Examples X, XI, XII, and XIII.

What is claimed is:

1. A method for high speed melt spinning of binder fiber comprising;

melting a polymer having a melting temperature range of greater than 0° C. to less than about 150° C., wherein said polymer comprises polyamides;

spinning said polymer at a speed of greater than about 2000 meters per minute to form said binder fiber; and winding said binder fiber onto a spin bobbin, wherein unwinding tension of said binder fiber from said spin bobbin is less than 2.0 grams on average.

2. A method according to claim 1, wherein said polymer comprises nylon 6/66/12 and 6/69.

3. A method according to claim 1, wherein said polymer comprises nylon 6/66/12.

4. A method according to claim 1, wherein said melting temperature range is greater than 0° C. to less than about 140° C.

5. A method according to claim 1, wherein said speed is greater than about 2500 meters per minute.

6. A method according to claim 1, wherein said speed is greater than about 3000 meters per minute.

7. A method according to claim 1, wherein spin finish is placed on said binder fiber prior to said winding.

8. A method according to claim 1, wherein unwinding tension of said binder fiber from said spin bobbin is less than 1.5 grams on average.

9. A method according to claim 1, wherein unwinding tension of said binder fiber from said spin bobbin is less than 1.0 grams on average.

10. A method according to claim 1, wherein said winding of said fiber comprises a speed substantially equal to said spinning speed.

11. A method according to claim 1, wherein said polymer exhibits substantially no exothermic crystallization peak as measured by DSC when it is cooled to solidification from a molten state by test A.

* * * * *